US011795761B2

(12) United States Patent
Riggins et al.

(10) Patent No.: US 11,795,761 B2
(45) Date of Patent: Oct. 24, 2023

(54) POSITIVE DISPLACEMENT MOTOR WITH A THERMOPLASTIC STATOR THAT CAN BE REPLACEABLE

(71) Applicant: Halliburton Energy Services, Inc., Houston, TX (US)

(72) Inventors: Carson Edward Riggins, Houston, TX (US); Harley Jones, II, Duncan, OK (US); Earl Webb, Duncan, OK (US); Philippe Quero, Houston, TX (US); Eric Bivens, Littleton, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/576,327

(22) Filed: Jan. 14, 2022

(65) Prior Publication Data

US 2023/0228152 A1 Jul. 20, 2023

(51) Int. Cl.
*E21B 4/02* (2006.01)

(52) U.S. Cl.
CPC ..... *E21B 4/02* (2013.01)

(58) Field of Classification Search
CPC ..... E21B 4/02
See application file for complete search history.

(56) References Cited

U.S. PATENT DOCUMENTS 5,518,379 A 5/1996 Harris et al.
5,785,509 A * 7/1998 Harris ..... F04C 13/008 418/179
5,833,444 A * 11/1998 Harris ..... E21B 4/02 418/113
6,336,502 B1 1/2002 Surjaatmadja et al.
7,396,220 B2 * 7/2008 Delpassand ..... F04C 13/008 418/153
9,309,767 B2 4/2016 Sreshta et al.
9,482,223 B2 11/2016 Jarvis et al.
9,540,933 B2 1/2017 Morris
2009/0152009 A1 6/2009 Slay et al.
2010/0038142 A1 * 2/2010 Snyder ..... E21B 4/02 175/57
2011/0116960 A1 * 5/2011 Akbari ..... F04C 13/002 418/48
2012/0201659 A1 * 8/2012 Savage ..... F04D 13/10 415/143

(Continued)

FOREIGN PATENT DOCUMENTS

CN 104563858 A 4/2015

OTHER PUBLICATIONS

International Search Report and Written Opinion, PCT/US2022/012664, dated Oct. 7, 2022, 10 pages.

*Primary Examiner* — Giovanna Wright
(74) *Attorney, Agent, or Firm* — Kilpatrick Townsend & Stockton LLP

(57) ABSTRACT

A positive displacement motor (PDM) is provided comprising an outer housing, a thermoplastic stator and a rotor. The PDM may additionally include a mechanism that allows the stator to be removable from the PDM when the PDM is not in operation and resists rotational movement of the stator with reference to a longitudinal axis of the stator and axial movement of the stator along the longitudinal axis of the stator when the PDM is operating, and a rotor disposed within the stator and configured to rotate within the stator when a fluid flows through the stator.

21 Claims, 2 Drawing Sheets

(56) References Cited

U.S. PATENT DOCUMENTS

| | | | | |
|---|---|---|---|---|
| 2017/0037685 | A1 | 2/2017 | Strachan | |
| 2017/0122034 | A1* | 5/2017 | Nichols | E21B 28/00 |
| 2019/0330925 | A1 | 10/2019 | Marchand et al. | |
| 2019/0345769 | A1 | 11/2019 | Schultz et al. | |

* cited by examiner

POSITIVE DISPLACEMENT MOTOR WITH A THERMOPLASTIC STATOR THAT CAN BE REPLACEABLE

TECHNICAL FIELD

The present disclosure relates generally to an apparatus for rotating a downhole tool to perform downhole operations in a wellbore. More specifically, though not exclusively, the present disclosure relates to a positive displacement motor (PDM) with a thermoplastic stator that can be replaceable.

BACKGROUND

Moving cavity motors, sometimes known as Positive-Displacement Motors (PDM), or progressive or progressing cavity motors make use of a power generation section which is made up of a rotor-stator combination. In order to move a rotor, a PDM requires hydraulic power from a fluid such as a drilling fluid flowing through the power generation section. PDMs work by trapping fluid in cavities formed in spaces between the rotor and the stator, and the relative rotation between these components is the mechanism which causes the cavities to progress and travel axially along the length of the device from the input end to the output end. If the fluid is pumped into the input end cavity at a higher pressure than that at the outlet end, the forces generated on the rotor cause it to rotate and the device will be a motor. In some cases, if the rotor is forced to rotate, fluid is drawn along in the cavities and the device can function as a pump.

In order for the rotor to rotate within the stator and generate cavities that will progress in an axial direction, the profiles of both components must take specific forms. Typically, the rotor is a helically shaped shaft. The number of lobes on the rotor can vary from one to any number. The stator has a profile which complements the shape of the rotor, with the number of lobes varying between two and any number. In a matching rotor-stator pair, the number of lobes on the stator is typically one greater than on the rotor. Seals can be maintained between the points of contact of the rotor and the stator. The seals define a plurality of cavities between the rotor and the stator and still allow for relative rotation between the rotor and stator.

When drilling fluid is pumped into the power generation section, the cavities act as wedges under pressure and the resulting forces cause the rotor to move. Given the helical shape of the rotor, such an application of force causes the rotor to rotate. This rotation is then transmitted to a drive shaft and from there on to an appropriate downhole tool depending on the downhole application.

PDMs are commonly used in drilling operations to circulate the drilling fluid and in a range of oil and gas well treatments, such as milling, drilling, chemical placement, matrix treatments, and scale removal, among others. However, the applicable service range of many of these applications is severely limited, due to the general low levels of compatibility of stator materials with high temperatures and/or exposure to gasses, solvents, acids, and other corrosive fluids.

BRIEF DESCRIPTION OF DRAWINGS

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modifications, alterations, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Many service applications for through-tubing tools require the capability to rotate a lower tool assembly, by means of a downhole motor. For the broadest range of deployment options, these motors are preferably flow activated. The most desirable configuration is a Positive Displacement Motor (PDM) which utilizes a rotor and stator configuration to impart rotation to the lower tool assembly by means of fluid flow through the power section of the tool. PDMs provide a suitable range of both torque and rotational speed to be suited for several downhole cleaning applications. However, existing tools exist only in configurations in which the stator material is either an elastomeric rubber compound or metal.

Use of elastomeric stator materials severely limit the service range of PDMs, as they are easily degraded by exposure to acids, solvents, gasses, high temperatures (high temperature generally identified as being above 300 F), or entrained solids. Likewise, the use of metallic stators is problematic in terms of exposure to acids and entrained solids, in terms of corrosion and rapid wear.

Furthermore, for both elastomeric and metal stators, the stator profile is either bonded to the tool housing, or an integral part of the housing, rendering the tools mostly disposable once the stator profile has become worn or otherwise compromised.

Embodiments of the present disclosure relate to an improved design for a Positive Displacement Motor (PDM) that addresses the limitations of present PDMs described above. In one or more embodiments, the stator of the PDM is made of a thermoplastic material that allows prolonged use in operations with exposure to acids, solvents, gasses, high temperatures, and/or entrained solids. The design of the PDM as described in embodiments of the present disclosure further allows for the stator to be easily removable from the PDM assembly which in turn enables selective and rapid redress or replacement of the stator, improving the overall re-usability and cost of the tool.

Figure 1A:
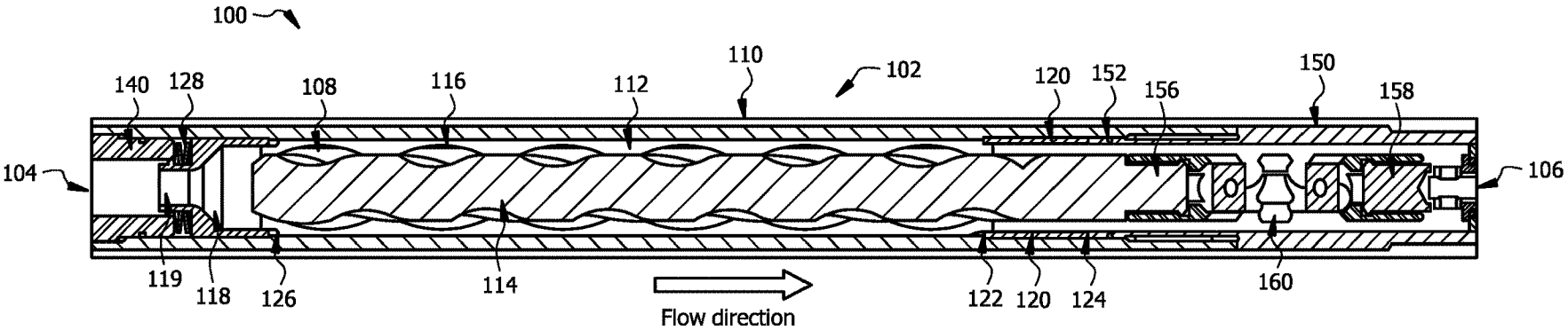
FIG. 1A illustrates a cross section of an example design of a PDM, in accordance with one or more embodiments of the present disclosure.

FIG. 1A illustrates a cross section of an example design of a PDM 100, in accordance with one or more embodiments of the present disclosure. PDM 100 includes a power generation section 102 having an uphole end 104 and a downhole end 106. The power generation section 102 is used to provide torque for operating a downhole tool (not shown) connected at the downhole end 106. The downhole tool connected to the downhole end 106 of the PDM 100 may include, but is not limited to, a jetting tool for cleaning debris built up in tubing or other pipe, a jetting head which has horizontal ports for cutting tubing, a fishing head utilized to thread into and remove debris stuck in a wellbore, or other tools which require or are useful with rotation in a wellbore.

The power generation section 102 includes a motor housing or outer housing 110 defining a longitudinal bore therethrough. A stator 112 is disposed in the outer housing 110. The outer housing 110 may have threads defined at an upper end thereof (e.g., near the uphole end 104) which may be connected to an upper connector 140 which is adapted for connection to a coiled tubing unit or other pipe or tool string. The power generation section 102 further includes a rotor 114 rotatably disposed in the stator 112. Stator 112 and rotor 114 define a longitudinally extending motor chamber 108, which may also be referred to as a driving chamber 108. As shown in FIG. 1A, the inner surface of the stator 112 is corrugated such that a helical screw-like profile is defined therealong. The outer surface of the rotor 114 defines a rounded substantially helical screw-type profile thereon. The interaction of the rotor 114 with the stator 112 and the motor chamber 108 forms a plurality of cavities 116 spaced along the length of the motor chamber 108.

A lower end of the rotor 114, near the downhole end 106 of the PDM 100, defines a rotor adapter 156 which is connected to a lower adapter 158 by a U-Joint 160. As shown in FIG. 1A, the rotor adapter 156, lower adapter 158 and U-Joint 160 form a coupling assembly which transfers the eccentric rotation of the Rotor 114 to a centralized rotation in the lower adapter 158, and thus to the downhole tool. In one or more embodiments, the lower adapter 158 may be connected to a speed controller (e.g., gear reducer) of a type known in the art. The speed controller is typically used to transmit at least a portion of the torque from the rotor 114 to a downhole tool and controls the speed of rotation of the downhole tool.

In one or more embodiments, the stator 112 may be made from a thermoplastic material which is resistant to high temperatures, acids, gasses, and aromatic solvents. Utilizing a thermoplastic stator 112 allows for prolonged use in operations with exposure to acids, solvents, gasses, high temperatures, and/or entrained solids, unlike existing PDM stator designs which are not capable of extended operation when exposed to these conditions. For example, the thermoplastic stator 112 may be rated for temperatures of 400° F. and above, which facilitates geothermal wellbore cleanout operations and scale removal in High Pressure-High Temperature (HPHT) wells. In one embodiment, the stator 112 may be made from a polyether ether ketone (PEEK) thermoplastic material. Stators made from PEEK thermoplastic material are extremely resistant to wear and may last significantly longer than existing bonded rubber stators. However, it may be appreciated that other thermoplastic materials may be used for the stator 112.

Additionally, utilizing a thermoplastic material for the stator 112 allows the stator 112 to be manufactured using several methods. For example, the stator 112 can be injection molded, 3D printed or machined out of a solid bar of the material. For example, the stator can be manufactured as a single piece including castellated profiles at either end of the stator 112.

The stator 112 may be secured in place within the outer housing 110, by means of chemical bonding, adhesive, or otherwise permanently affixed, to enable a more simplistic build. However the design of the PDM 100 described in accordance with embodiments of the present disclosure provides the ability for the stator 112 to be removable from the outer housing 110.

Figure 1B:
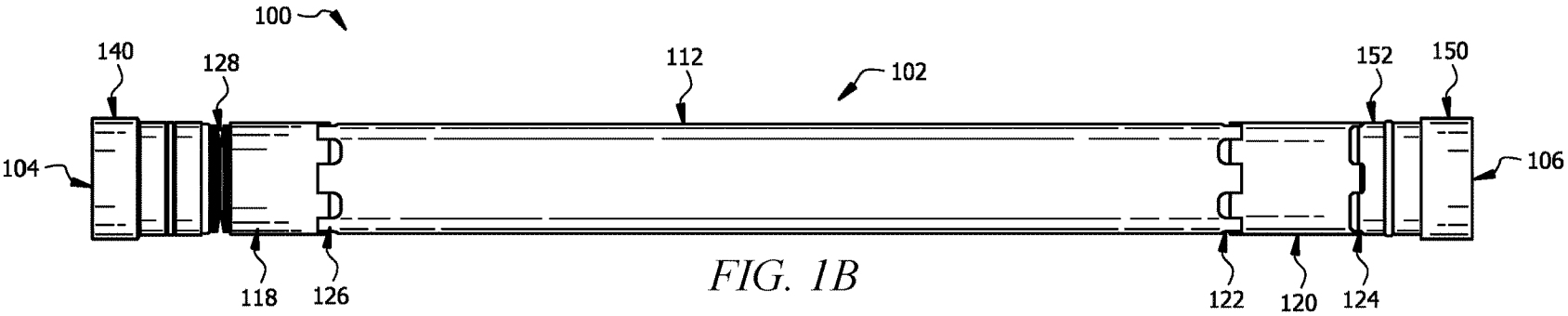
FIG. 1B illustrates a view of the PDM shown in FIG. 1A without the outer housing, in accordance with one or more embodiments of the present disclosure.

The stator 112 is fixed in place within the outer housing 110 by an upper retainer 118 and a lower retainer 120. As shown in FIG. 1B, the stator 112 has a castellated profile at an upper end 126 (near the uphole end 104) and a lower end 122 (near the downhole end 106). The upper retainer 118 and the lower retainer 120 have castellated profiles that correspond to and match with the castellated profiles at the upper end 126 and lower end 122 respectively of the stator 112. As shown in FIG. 1B, the castellated profile at a first end of the upper retainer 118 mates and locks with the matching castellated profile at the upper end 126 of the stator 112. Similarly, the castellated profile at the first end of the lower retainer 120 mates and locks with the matching castellated profile at the lower end 122 of the stator 112. Accordingly, the upper retainer 118 and the lower retainer 120, because of their castellated profiles locked with those of the stator 112, resist rotation of the stator 112 on its own longitudinal axis (e.g., within the outer housing 110) when the PDM 100 is in operation. Operation of the PDM 100 may include pumping pressurized fluid through the motor chamber 108 to force rotation of the rotor 114 within the stator 112. As further described below, the retainers 118 and 120 also help resist axial movement of the stator 112 along the length of the stator (e.g., within the outer housing 110).

In one or more embodiments, a second end of the upper retainer 118 has a funneled profile with a stem 119 at the very end. One or more springs 128 may be mounted on the stem 119 positioned between the upper connector 140 and the upper retainer 118. The spring 128 is compressed when the upper connector 140 is coupled to and tightened against the remaining PDM assembly downhole from the upper connector 140. The spring 128 allows for variations in axial stack up of the various parts of the PDM assembly. For example, when the upper connector 140 is coupled to the upper retainer 118 and tightened, a compressive load is applied to the spring 128 and the assembly below the spring 128. The compressive load allows tension to remain applied on the stator 112 so that axial movement of the stator 112 along the longitudinal axis of the stator 112 is resisted. In one embodiment, the spring 128 includes one or more conical spring washers mounted on the stem 119 of the upper retainer 118 and stacked between the upper connector 140 and the upper retainer 118.

In one or more embodiments, a second end of the lower retainer 120 also has a castellated profile that locks with a matching castellated profile on an upper end 152 of a lower housing 150. Once the PDM 100 is assembled as shown in FIGS. 1A and 1B and described above, the stator 112 is locked in place within the outer housing 110, where the retainers 118 and 120 along with the spring 128 pressed against the stator 112 resist axial movement of the stator 112 (along the longitudinal stator axis) as well as rotational movement of the stator 112 (with reference to the longitudinal stator axis) within the outer housing 110.

The outer housing 110 at least covers a portion of the upper connector 140, the spring 128, the upper retainer 118, the stator 112, the lower retainer 120 and at least a portion of the upper end 152 of the lower housing 150. In one embodiment, the outer housing 110 is not connected to the stator 112 and is merely used to help provide a uniform outer diameter for the PDM 100. It may be noted that FIG. 1B shows the PDM 100 assembly without the outer housing 110. Further, in FIG. 1B, the spring 128 is shown in its compressed form and the stem 119 is hidden inside the upper connector 140.

In operation, fluid (e.g., drilling fluid, cleaning fluid, or other treatment fluid) is pumped under pressure through a tubing string (or jointed pipe) into the PDM 100. The fluid is forced to flow through the motor chamber 108 causing rotation of the rotor 114 within the stator 112. Rotation of the rotor 114 results in rotation of the U-joint assembly 160 which in turn transmits the rotation to a downhole tool connected below the power generation section 102.

The design of the PDM as described above with reference to FIGS. 1A and 1B including the combination of the retainer pieces and the springs allows for the stator to be held in a fixed position (e.g., no rotational or axial movement) within the outer housing, thus avoiding the need to bond the stator to the outer housing. Accordingly, the design of the PDM as described in this disclosure allows the stator to be easily removed from the PDM (e.g., outer housing 110) without the need to de-bond the stator 112 from the outer housing 110, thus enabling rapid changeout of the stator. This results in reduced costs associated with the PDM tool in production as well as redress, as the initial build does not require a bonding process and the stator section alone may be replaced if needed with the remainder of the tool being re-usable. However, it may be appreciated by a person having ordinary skill in the art that the stator 112 may also be bonded or permanently integrated into the outer housing 110.

It may be noted that the stator 112 may be fixed in position within the outer housing 110 by alternative mechanisms. For example, the stator 112 may be held in a fixed position within the housing 110 through the use of one or more other securing mechanisms including, but not limited to, a keyed profile to lock the stator in the housing 110, removable set screws, serrated washers, or any combination thereof. In certain embodiments, one or more of these securing mechanisms may be used in place of or in combination with the securing mechanism described with reference to FIGS. 1A and 1B including the upper retainer 118, the lower retainer 120 and spring 128.

In one embodiment, instead of using the upper retainer 118 and the lower retainer 120, keys may be used in the outer housing 110 to align the stator 112 tangentially and resist rotational movement of the stator 112 on its own longitudinal axis. For example, the outer housing 110 may have at least one key protruding from an interior surface of the outer housing 110 that fits into a corresponding key slot on the outer surface of the stator 112, wherein the at least one key after fitting into the corresponding key slot resists rotational movement of the stator 112 within the outer housing 110. The at least one key may include a longitudinal protrusion from the interior surface of the outer housing 110 along a longitudinal axis of the outer housing and the key slot may include a matching longitudinal slot on the surface of the stator 112 that matches the at least one key.

Figure 2:
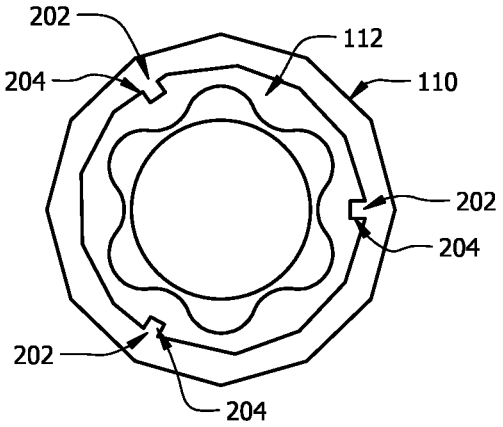
FIG. 2 is a cross-sectional end view of a PDM having a keyed configuration to fix the stator 112 in position within the outer housing 110, in accordance with one or more embodiments of the present disclosure.

FIG. 2 is a cross-sectional end view of a PDM having a keyed configuration to fix the stator 112 in position within the outer housing 110, in accordance with one or more embodiments of the present disclosure. As shown in FIG. 2, the keyed configuration includes three keys 202 positioned around the inner circumference of the outer housing 110, which fit into matching key slots 204 provided on the outer surface of the stator 112. The keys 202 and the matching key slots 204 may extend longitudinally from one end to the other end of the outer housing 110 and stator 112 respectively, such that the keys 202 of the outer housing 110 may be aligned with the corresponding key slots of the stator 112 and the outer housing 110 can be slid onto the stator 112. While FIG. 2 shows three keys 202 and three matching key slots 204, it may be appreciated that more or less keys 202 and key slots 204 may be used.

In one embodiment, instead of using castellations provided on either end of the stator 112 and the retainers 118 and 120 to resist rotational movement of the stator 112, serrated washers may be used at either end of the stator 112 to resist the torque applied to the stator 112 as a result of the rotating rotor 114. For example, instead of using the upper retainer 118, a serrated washer may be positioned between the upper connector 140 and the upper end 126 of the stator 112. As the upper connector 140 is tightened against the stator 112, the teeth of the washer bite into the stator 112 and resist rotational motion of the stator 112. Similarly, instead of using the lower retainer 120, a serrated washer may be positioned between the lower end 122 of the stator 112 and the upper end 152 of the lower housing 150 such that the teeth of the washer bite into the lower end 122 of the stator 112 to resist the rotational movement of the stator. In this case, the stator 112 does not need to have a castellated profile at either ends.

In an alternative embodiment, instead of a castellated profile, the upper retainer 118 may have a toothed profile at the first end, wherein the toothed profile bites into the upper end of the stator 112 to resist rotational movement of the stator. Similarly, the lower retainer 120 may have a toothed profile at the first end, wherein toothed profile bites into the lower end of the stator 112 to resist rotational movement of the stator.

Figure 3:
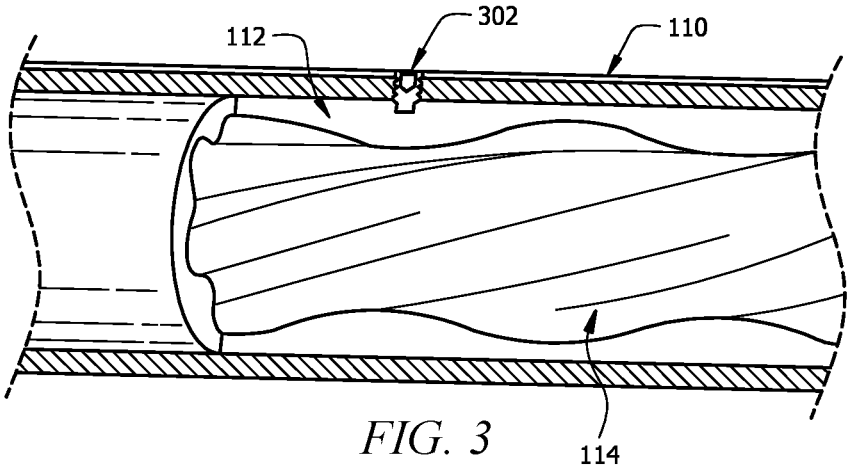
FIG. 3 illustrates a set screw configuration for securing a stator to an outer housing of a PDM, in accordance with one or more embodiments of the present disclosure.

In an additional or alternative embodiment, to resist axial movement of the stator 112 along the longitudinal axis, a retaining ring may be used on the upper end 126 of the stator 112. In another additional or alternative embodiment, a set screw configuration may be used to hold the stator in place within the outer housing 110 and resist axial movement and rotational movement of the stator 112 within the outer housing 110. As shown in FIG. 3, the set screw configuration may include at least one set screw 302 that passes through the outer housing 110 and into the stator 112, thus locking the stator 112 to the outer housing 110 and resisting movement of the stator 112 within the outer housing 110. It may be noted that a plurality of set screws may be used along the length and circumference of the outer housing 110 to enhance the locking of the stator 112 to the outer housing 110. It may be noted that the retaining ring and/or set screws may be used in place of or in addition to the spring 128 shown in FIG. 1A.

One or more embodiments of the present disclosure provide a positive displacement motor (PDM) including an outer housing; a stator positioned in the outer housing, wherein the stator is made of a thermoplastic material; and a rotor disposed within the stator and configured to rotate within the stator when a fluid flows through the stator In one or more embodiments, the PDM further includes a mechanism that allows the stator to be removable from the PDM when the PDM is not in operation, wherein the mechanism resists rotational movement of the stator with reference to a longitudinal axis of the stator and resists axial movement of the stator along the longitudinal axis of the stator when the PDM is operating.

In one or more embodiments, the mechanism includes a castellated profile provided at each of an upper end and lower end of the stator; an upper retainer having a castellated profile at a first end, wherein the castellated profile at the upper end of the stator locks with the castellated profile at the first end of the upper retainer; and a lower retainer having a castellated profile at each of a first end and second end, wherein the castellated profile at the lower end of the stator locks with the castellated profile at the first end of the lower retainer, wherein the upper retainer and lower retainer resist the rotational movement and axial movement of the stator.

In one or more embodiments, the stator is a single piece including the castellated profiles at the upper end and the lower end of the stator.

In one or more embodiments, the mechanism further includes at least one spring positioned between an upper connector and a second end of the upper retainer, wherein the at least one spring is compressed when the second end of the upper retainer is coupled to the upper connector, wherein the at least one spring provides tolerance for variations in axial stack up of parts included in the positive displacement motor.

In one or more embodiments, the at least one spring comprises a set of conical spring washers stacked between the upper connector and the upper retainer.

In one or more embodiments, the mechanism further includes a castellated profile provided at an upper end of a lower housing, wherein the castellated profile of the lower housing locks with the castellated profile at the second end of the lower retainer.

In one or more embodiments, the outer housing at least covers the upper retainer, the stator, the lower retainer and at least a portion of the lower housing at the upper end of the lower housing.

In one or more embodiments, the mechanism includes at least one key protruding from an interior surface of the outer housing and that fits into a corresponding key slot on the outer surface of the stator, wherein the at least one key after fitting into the corresponding key slot resists the rotational movement of the stator within the outer housing; and at least one set screw passing through the outer housing into the stator to resist the axial movement of the stator.

In one or more embodiments, the at least one key comprises a longitudinal protrusion from the interior surface of the outer housing along a longitudinal axis of the outer housing and the key slot comprises a matching longitudinal slot on the surface of the stator that matches the at least one key.

In one or more embodiments, the mechanism includes an upper retainer having a toothed profile at a first end, wherein the toothed profile bites into an upper end of the stator to resist rotational movement of the stator; and a lower retainer having a toothed profile at a first end, wherein toothed profile bites into a lower end of the stator to resist rotational movement of the stator.

In one or more embodiments, the thermoplastic material comprises a polyether ether ketone (PEEK) thermoplastic material.

One or more embodiments of the present disclosure provide a positive displacement motor (PDM) including an outer housing; a stator positioned in the outer housing; a mechanism that allows the stator to be removable from the PDM when the PDM is not in operation and resists rotational movement of the stator with reference to a longitudinal axis of the stator and axial movement of the stator along the longitudinal axis of the stator when the PDM is operating; and a rotor disposed within the stator and configured to rotate within the stator when a fluid flows through the stator.

In one or more embodiments, the mechanism includes a castellated profile provided at each of an upper end and lower end of the stator; an upper retainer having a castellated profile at a first end, wherein the castellated profile at the upper end of the stator locks with the castellated profile at the first end of the upper retainer; and a lower retainer having a castellated profile at each of a first end and second end, wherein the castellated profile at the lower end of the stator locks with the castellated profile at the first end of the lower retainer, wherein the upper retainer and lower retainer resist the rotational movement and axial movement of the stator.

In one or more embodiments, the stator is a single piece including the castellated profiles at the upper end and the lower end of the stator.

In one or more embodiments, the mechanism further includes at least one spring positioned between an upper connector and a second end of the upper retainer, wherein the at least one spring is compressed when the second end of the upper retainer is coupled to the upper connector, wherein the at least one spring provides tolerance for variations in axial stack up of parts included in the positive displacement motor.

In one or more embodiments, the at least one spring comprises a set of conical spring washers stacked between the upper connector and the upper retainer.

In one or more embodiments, the mechanism further includes a castellated profile provided at an upper end of a lower housing, wherein the castellated profile of the lower housing locks with the castellated profile at the second end of the lower retainer.

In one or more embodiments, the outer housing at least covers the upper retainer, the stator, the lower retainer and at least a portion of the lower housing at the upper end of the lower housing.

In one or more embodiments, the mechanism includes at least one key protruding from an interior surface of the outer housing and that fits into a corresponding key slot on the outer surface of the stator, wherein the at least one key after fitting into the corresponding key slot resists the rotational movement of the stator within the outer housing; and at least one set screw passing through the outer housing into the stator to resist the axial movement of the stator.

In one or more embodiments, the at least one key comprises a longitudinal protrusion from the interior surface of the outer housing along a longitudinal axis of the outer housing and the key slot comprises a matching longitudinal slot on the surface of the stator that matches the at least one key.

In one or more embodiments, the mechanism includes an upper retainer having a toothed profile at a first end, wherein the toothed profile bites into an upper end of the stator to resist rotational movement of the stator; and a lower retainer having a toothed profile at a first end, wherein toothed profile bites into a lower end of the stator to resist rotational movement of the stator.

In one or more embodiments, the stator is made of a thermoplastic material.

In one or more embodiments, the thermoplastic material comprises a polyether ether ketone (PEEK) thermoplastic material.

One or more embodiments of the present disclosure provide a positive displacement motor (PDM) including an outer housing; a stator positioned in the outer housing, wherein a castellated profile is provided at each of an upper end and lower end of the stator; an upper retainer having a castellated profile at a first end, wherein the castellated profile at the upper end of the stator locks with the castellated profile at the first end of the upper retainer; a lower retainer having a castellated profile at each of a first end and second end, wherein the castellated profile at the lower end of the stator locks with the castellated profile at the first end of the lower retainer, wherein the upper retainer and lower retainer resist rotational movement of the stator with reference to a longitudinal axis of the stator and axial movement of the stator along the longitudinal axis of the stator when the PDM is operating, wherein the stator is removable from the PDM by unlocking the corresponding castellated profiles of the stator and the upper and lower retainers; and a rotor disposed within the stator and configured to rotate within the stator when a fluid flows through the stator.

In one or more embodiments, the stator is a single piece including the castellated profiles at the upper end and the lower end of the stator.

In one or more embodiments, the PDM further includes at least one spring positioned between an upper connector and a second end of the upper retainer, wherein the at least one spring is loaded when the second end of the upper retainer is coupled to the upper connector, wherein the at least one spring provides tolerance for variations in axial stack up of parts included in the positive displacement motor.

In one or more embodiments, the at least one spring comprises a set of conical spring washers stacked between the upper connector and the upper retainer.

In one or more embodiments, wherein the PDM further includes a lower housing having a castellated profile at an upper end of the lower housing, wherein the castellated profile of the lower housing locks with the castellated profile at the second end of the lower retainer.

In one or more embodiments, the outer housing at least covers the upper retainer, the stator, the lower retainer and at least a portion of the lower housing at the upper end of the lower housing.

In one or more embodiments, the stator is made of a thermoplastic material.

In one or more embodiments, the thermoplastic material comprises a polyether ether ketone (PEEK) thermoplastic material.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the elements that it introduces.

What is claimed is:

1. A positive displacement motor (PDM), comprising:

an outer housing;

a stator positioned in the outer housing, wherein the stator is made of a thermoplastic material;

at least one spring positioned between an upper connector couplable to the outer housing and an end of an upper retainer configured to fix the stator in place in the outer housing, wherein the at least one spring is positioned to resist axial movement of the stator along a longitudinal axis of the stator when the PDM is operating, and wherein the at least one spring is compressed when the end of the upper retainer is coupled to the upper connector; and a rotor disposed within the stator and configured to rotate within the stator when a fluid flows through the stator.

2. The positive displacement motor of claim 1, further comprising a mechanism that allows the stator to be removable from the PDM when the PDM is not in operation, wherein the mechanism resists rotational movement of the stator with reference to a longitudinal axis of the stator and resists axial movement of the stator along the longitudinal axis of the stator when the PDM is operating.

3. The positive displacement motor of claim 2, wherein the end of the upper retainer is a second end, and wherein the mechanism comprises:

a castellated profile provided at each of an upper end and lower end of the stator;

the upper retainer having a castellated profile at a first end, wherein the castellated profile at the upper end of the stator locks with the castellated profile at the first end of the upper retainer; and a lower retainer having a castellated profile at each of a first end and second end, wherein the castellated profile at the lower end of the stator locks with the castellated profile at the first end of the lower retainer, wherein the upper retainer and lower retainer resist the rotational movement and axial movement of the stator.

4. The positive displacement motor of claim 3, wherein the stator is a single piece including the castellated profiles at the upper end and the lower end of the stator.

5. The positive displacement motor of claim 3, wherein the mechanism further comprises:

the at least one spring positioned between the upper connector and the second end of the upper retainer, wherein the at least one spring provides tolerance for variations in axial stack up of parts included in the positive displacement motor.

6. The positive displacement motor of claim 5, wherein the at least one spring comprises a set of conical spring washers stacked between the upper connector and the upper retainer.

7. The positive displacement motor of claim 3, wherein the mechanism further comprises:

a castellated profile provided at an upper end of a lower housing, wherein the castellated profile of the lower housing locks with the castellated profile at the second end of the lower retainer.

8. The positive displacement motor of claim 7, wherein the outer housing at least covers the upper retainer, the stator, the lower retainer and at least a portion of the lower housing at the upper end of the lower housing.

9. The positive displacement motor of claim 1, wherein the thermoplastic material comprises a polyether ether ketone (PEEK) thermoplastic material.

10. A positive displacement motor (PDM), comprising:

an outer housing;

a stator positioned in the outer housing;

a mechanism that allows the stator to be removable from the PDM when the PDM is not in operation, wherein the mechanism comprises at least one spring positioned between an upper connector couplable to the outer housing and an end of an upper retainer configured to fix the stator in place in the outer housing, wherein the at least one spring is compressed when the end of the upper retainer is coupled to the upper connector, wherein the mechanism resists rotational movement of the stator with reference to a longitudinal axis of the stator and resists axial movement of the stator along the longitudinal axis of the stator when the PDM is operating; and a rotor disposed within the stator and configured to rotate within the stator when a fluid flows through the stator.

11. The positive displacement motor of claim 10, wherein the end of the upper retainer is a second end, and wherein the mechanism comprises:

a castellated profile provided at each of an upper end and lower end of the stator;

the upper retainer having a castellated profile at a first end, wherein the castellated profile at the upper end of the stator locks with the castellated profile at the first end of the upper retainer; and a lower retainer having a castellated profile at each of a first end and second end, wherein the castellated profile at the lower end of the stator locks with the castellated profile at the first end of the lower retainer, wherein the upper retainer and lower retainer resist the rotational movement and axial movement of the stator.

12. The positive displacement motor of claim 11, wherein the mechanism further comprises:

the at least one spring positioned between the upper connector and the second end of the upper retainer, wherein the at least one spring provides tolerance for variations in axial stack up of parts included in the positive displacement motor.

13. The positive displacement motor of claim 11, wherein the mechanism further comprises:

a castellated profile provided at an upper end of a lower housing, wherein the castellated profile of the lower housing locks with the castellated profile at the second end of the lower retainer.

14. The positive displacement motor of claim 10, wherein the mechanism comprises:

at least one key protruding from an interior surface of the outer housing and that fits into a corresponding key slot on an outer surface of the stator, wherein the at least one key after fitting into the corresponding key slot resists the rotational movement of the stator within the outer housing; and at least one set screw passing through the outer housing into the stator to resist the axial movement of the stator.

15. The positive displacement motor of claim 14, wherein the at least one key comprises a longitudinal protrusion from the interior surface of the outer housing along a longitudinal axis of the outer housing and the corresponding key slot comprises a matching longitudinal slot on the outer surface of the stator that matches the at least one key.

16. The positive displacement motor of claim 10, wherein the mechanism comprises:

an upper retainer having a toothed profile at a first end, wherein the toothed profile bites into an upper end of the stator to resist rotational movement of the stator; and a lower retainer having a toothed profile at a first end, wherein toothed profile bites into a lower end of the stator to resist rotational movement of the stator.

17. A positive displacement motor (PDM), comprising:

an outer housing;

a stator positioned in the outer housing, wherein a castellated profile is provided at each of an upper end and lower end of the stator;

an upper retainer having a castellated profile at a first end, wherein the castellated profile at the upper end of the stator locks with the castellated profile at the first end of the upper retainer;

a lower retainer having a castellated profile at each of a first end and second end, wherein the castellated profile at the lower end of the stator locks with the castellated profile at the first end of the lower retainer, wherein the upper retainer and lower retainer resist rotational movement of the stator with reference to a longitudinal axis of the stator and axial movement of the stator along the longitudinal axis of the stator when the PDM is operating, wherein the stator is removable from the PDM by unlocking the corresponding castellated profiles of the stator and the upper and lower retainers;

at least one spring positioned between an upper connector couplable to the outer housing and a second end of the upper retainer, wherein the at least one spring is loaded when the second end of the upper retainer is coupled to the upper connector; and a rotor disposed within the stator and configured to rotate within the stator when a fluid flows through the stator.

18. The positive displacement motor of claim 17, further comprising:

the at least one spring positioned between the upper connector and the second end of the upper retainer, wherein the at least one spring provides tolerance for variations in axial stack up of parts included in the positive displacement motor.

19. The positive displacement motor of claim 17, further comprising:

a lower housing having a castellated profile at an upper end of the lower housing, wherein the castellated profile of the lower housing locks with the castellated profile at the second end of the lower retainer.

20. The positive displacement motor of claim 19, wherein the outer housing at least covers the upper retainer, the stator, the lower retainer and at least a portion of the lower housing at the upper end of the lower housing.

21. The positive displacement motor of claim 17, wherein the stator is made of a thermoplastic material.

* * * * *